US006626430B1

(12) United States Patent
Schmid et al.

(10) Patent No.: US 6,626,430 B1
(45) Date of Patent: Sep. 30, 2003

(54) DEVICE FOR STACKING SHEETS

(75) Inventors: Frank Schmid, Krefeld (DE); Armin Kloke, Düsseldorf (DE)

(73) Assignee: Jagenberg Querschneider GmbH, Neuss (DE)

( * ) Notice: Subject to any disclaimer, the term of this patent is extended or adjusted under 35 U.S.C. 154(b) by 0 days.

(21) Appl. No.: 09/787,931

(22) PCT Filed: Sep. 30, 1999

(86) PCT No.: PCT/EP99/07259

§ 371 (c)(1),
(2), (4) Date: Mar. 21, 2001

(87) PCT Pub. No.: WO00/20315

PCT Pub. Date: Apr. 13, 2000

(30) Foreign Application Priority Data

Oct. 5, 1998 (DE) ..... 198 45 850

(51) Int. Cl.[7] ..... B65H 31/10; B65H 31/20

(52) U.S. Cl. ..... 271/207; 271/223; 271/240; 271/118

(58) Field of Search ..... 271/207, 118, 271/223, 240

(56) References Cited

FOREIGN PATENT DOCUMENTS

| | | |
|---|---|---|
| DE | 31 14 414 A1 | 10/1982 |
| DE | 36 01 295 A1 | 7/1987 |

*Primary Examiner*—Donald P. Walsh
*Assistant Examiner*—Jonathan R Miller
(74) *Attorney, Agent, or Firm*—Herbert Dubno; Andrew Wilford

(57) ABSTRACT

An apparatus for stacking sheets has a conveyor for delivering a succession of the sheets in a longitudinal transport direction on a conveyor plane to an upstream side of a stacking station with longitudinal edges of the sheets extending parallel to the direction. A vertically displaceable platform in the station below the plane receives the sheets in a stack. A row of upper feed belts extending in the direction immediately above the conveyor and the stacking station has lower reaches engageable down against the sheets on the conveyor at the upstream side of the station. A feed-belt adjuster moves the upper feed belts transversely of the direction and sets the upper feed belts in any of a plurality of different transversely offset positions.

11 Claims, 5 Drawing Sheets

DEVICE FOR STACKING SHEETS

CROSS REFERENCE TO RELATED APPLICATIONS

This application is the US national phase of PCT application PCT/EP99/07259 filed Sep. 30, 1999 with a claim to the priority of German patent application 19845850.9 itself filed Oct. 5, 1998.

FIELD OF THE INVENTION

The invention relates to an apparatus for stacking sheets, in particular overlapping and moving paper or cardboard sheets onto pallets, having a vertically fixed but height-adjustable conveyor above the maximum stack height with a raisable and lowerable deposition platform on which the stacks are formed and a row of upper belts that extend from the conveyor at least into the stacking station and that coact with further stack-forming elements that are effective on the longitudinal edges of the sheets, the upper belts and the further stack-forming elements being positionable along the working width by means of an adjustment device.

BACKGROUND OF THE INVENTION

Apparatuses for transversely cutting paper or cardboard webs normally end at a stacking apparatus where the sheets produced by transverse cutting are deposited with their edges aligned in stacks. Normally the sheets are transported in overlapping condition by a belt conveyor to the stacking station where they are stacked on pallets that sit on a deposition platform. The deposition platform can be raised in the frame of the stacking machine to the level of the conveyor plane and can be dropped down to the floor. One or more stacks are formed on the deposition platform in case the paper or cardboard web has been cut into several strips prior to transverse subdivision.

At the end of the conveyor and in the stacking station there are known stack-forming elements that ensure a trouble-free guiding in the stacking station and good edge alignment in the stack or stacks. When the format and/or the number of stacks changes the stack-forming elements must be repositioned both transverse to the sheet-travel direction and in the sheet-travel direction since their desired position is dependent on the length and/or width of the sheets being deposited.

The stack-forming elements must all be positioned transversely as they act on the longitudinal sheet edges or must be moved out of the sheet-edge regions since they would there interfere with the operation of the active elements. The elements working on the longitudinal sheet edges are separating shoes that are arranged at the end of the conveyor and that impart to each sheet a shape-stabilizing curved shape and in a multiple-line operation ensure a separate guiding of two adjacent sheets in the stacking station. Furthermore there is at each longitudinal edge of each stack being formed in the stacking station an upright separating plate extending in the sheet-travel direction and engaging the longitudinal edge of the respective stack. Normally the separating plates are vibrated in order to ensure the proper edge alignment of the sheets in a stack.

Further transversely positionable stack-forming elements are feed rollers and upper belts that preferably are arranged at uniform transverse spacings above the stacking station. The feed rollers are arranged at spacings in the region of the ends of the conveyor immediately above the feed plane. They ensure the transfer of the sheets from the conveyor into the stacking station. In order to guide the sheets also in the stacking station, above the conveyor plane are several upper belts extending in the transport direction at least into the stacking station and arranged at a spacing from one another. A stacking apparatus for sensitive paper has its upper belts extending over the entire stacking station. Feed rollers and upper belts are preferably set in a plane. They need in order to accurately transport the sheets not to be too far from each other and not to be set at the longitudinal sheet edges since they would there interfere with operation of the separating shoes and separating plates.

Stack-forming elements whose positions are dependent on the sheet length and that must therefore be positioned longitudinally are one or more stop plates against which the leading edges of the sheets are aligned. At the same time it is also necessary to position the separating plates longitudinally so that they can act on the right position on the longitudinal edges.

German 3,114,414 describes such an apparatus that makes it possible to automatically reset the stack-forming elements when format is changed. To this end the apparatus has a row of entrainment shafts extending in the transport direction, one entrainment shaft carrying two upper belts, two feed rollers, a stop plate and, between the upper belts, a separating shoe and a separating plate. All the stack-forming elements on an entrainment shaft are thus moved together with the entrainment shaft into a new position.

This solution is expensive to manufacture since the number of necessary upper belts is equal to the number of the stack-forming elements effective on the longitudinal edges. Should for example when stacking sensitive papers the spacing between two upper belts be at most 200 mm, with a working width of about 2200 mm, more than ten entrainment shafts for the necessary number of upper belts with the necessary stack-forming elements are necessary. The stack-forming elements only acting on one sheet longitudinal edge (separating shoes, separating plates) whose necessary number is equal to the number of longitudinal edges, thus of the number of adjacent stacks, are set, so a great number must be maintained.

OBJECT OF THE INVENTION

It is therefore an object of the invention to improve on such an apparatus such that it is possible to substantially automatically transversely position the individual stack-forming elements at the lowest possible manufacturing cost.

SUMMARY OF THE INVENTION

This object is achieved according to the invention in that the upper belts are adjustable independently of the stack-forming elements effective on the longitudinal edges. This makes it possible to limit the number of stack-forming elements effective on the longitudinal edges of the sheets being stacked to their necessary number (number of users+1).

The raisability of the separating shoes to above the upper belts makes it possible to move them independently of the upper belts and simultaneously therewith into a new transverse position.

In case feed rollers are provided, these are advantageously mounted directly above the active lower reach of the upper belts. Since then their transverse positions correspond o those of the upper belts, they have advantageously a common adjustment mechanism with the upper belts. According to the particularly advantageous embodiment each feed roller is mounted on a holder that also forms a guide for an upper belt. This makes it possible to couple the holder to the adjustment device and thus to move the respective upper belt without its own coupling device during adjustment of the feed roller into its new transverse position. In order to achieve this with the lowest possible manufacturing costs, the circulating upper belts are looped at upstream and downstream ends over rollers extending the full working width. The upper belts thus are easy to slide on the rollers.

According to the invention, a transversely positionable separating plate is provided in the stacking station at each longitudinal edge of a sheet. The separating plates have their own adjustment mechanisms for their transverse positioning. In case the separating plates also have to be positioned longitudinally, this can be done in a simple manner with a separate transverse-adjustment mechanism. If no longitudinal positioning is necessary, the separating plates are coupled to the transverse-adjustment device of the separating shoes since they also act on the longitudinal edges of the sheets.

In order to deposit sensitive paper sheets it is necessary to guide these by means of the upper belts over the entire stacking station. The upper belts reach to this end over the entire stacking station in order to cover the maximum sheet length. On depositing short sheets one must avoid collisions of the leading edges with the stop plates positionable longitudinally. With the described embodiment according to German 3,114,414 the stop plate is formed as a row of short segments that must jointly be positioned transversely with the upper belts.

According to a particularly advantageous embodiment of a stacking apparatus a one-piece stop plate is used so that transverse positioning of separate stop plates is not necessary. Transverse adjustment of the upper belts is still possible since these can only assume predetermined transversely spaced positions. Collisions with the one-piece stop plate are thus avoided in that it has cutouts in all possible transverse positions of the upper belts through which same pass.

The stop plates can be moved out of the region of the upper belts so same can be transversely positioned. This is much simpler than moving them longitudinally from the region of the upper belts. In an advantageous embodiment of the adjustment device for transverse positioning, an absolute-measuring position-detecting system makes it possible to directly control the individual desired positions.

BRIEF DESCRIPTION OF THE DRAWING

The drawing serves to describe the invention with reference to a simplified illustrated embodiment. Therein.

SPECIFIC DESCRIPTION

Figure 1:
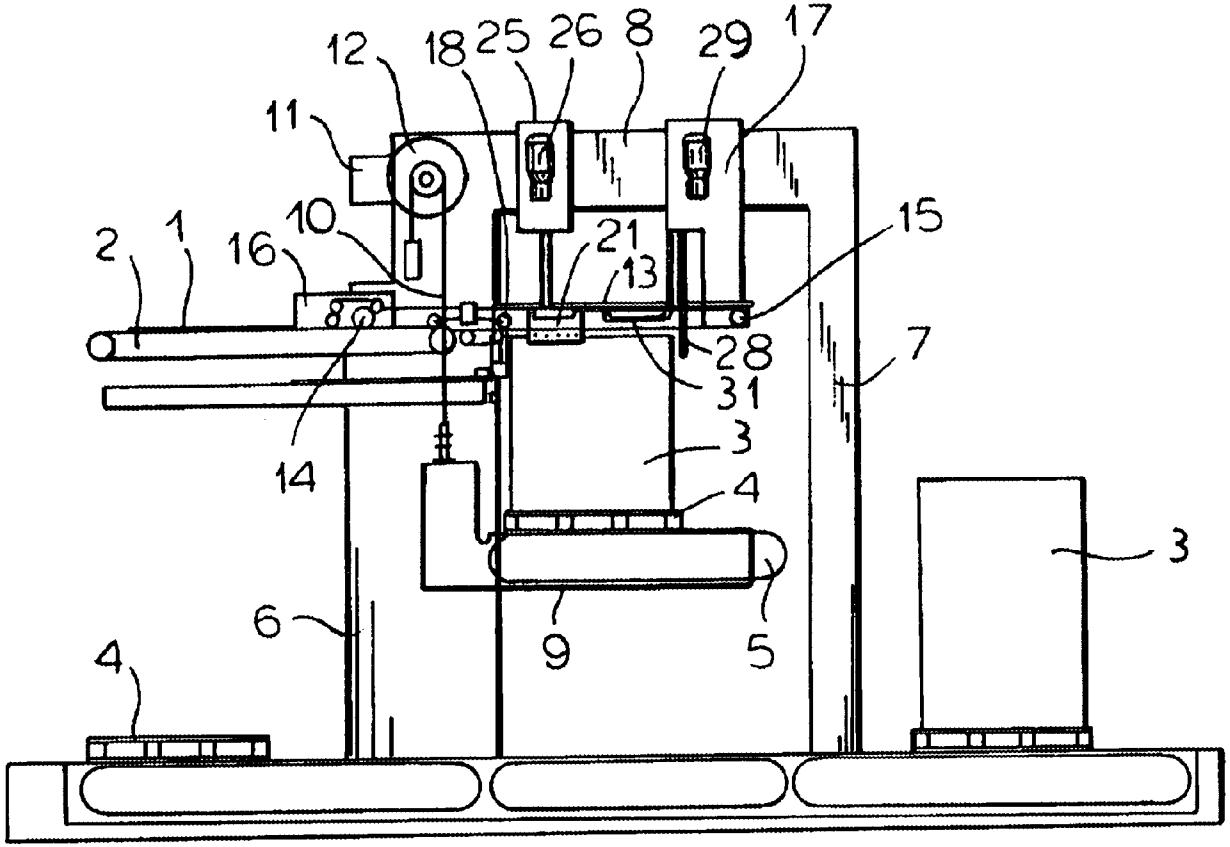
FIG. 1 is a schematic side view of the stacking apparatus.

The illustrated stacking apparatus serves to stack continuously arriving overlapping paper sheets 1 that are produced in a transverse-cutting machine. The sheets 1 are fed to a stacking station by a belt-type conveyor 2 that is arranged at a fixed vertical position above the floor and above the maximum stacking height. A stack 3 is formed on pallets 4 that lie on a deposition platform 5. The deposition platform 5 can be raised in a frame of the stacking apparatus to the feed level of the sheets 1 and dropped to near the floor.

The frame of the apparatus comprises two upstream posts 6 and two downstream posts 7 that are outside the working width of the two longitudinal sides of the machine and that are connected at their upper ends by longitudinal beams 8 and transverse beams not shown in FIG. 1. The posts 6 and 7 define the limits of the stacking station. A support 9 hung via chains 10 on the inner sides of the upstream posts 6 is vertically movable and its horizontal parts carry the deposition platform 5. An electric motor 11, preferably a servomotor, does the lifting and is connected via a synchronizing shaft extending transversely across the station between the upper transverse beams and carrying on each side of the machine a sprocket 12 over which the respective chain 10 passes.

At the feed plane of the sheets 1 there are various elements for a trouble-free feeding of the sheets 1 into the stacking station and their edge-aligned deposition on the stack 3. Up to four stacks 3 are formed next to one another. The paper strip from which the sheets 1 are cut is also cut longitudinally in the transverse cutting machine into a plurality of longitudinal substrips before being cut transversely.

Figure 2:
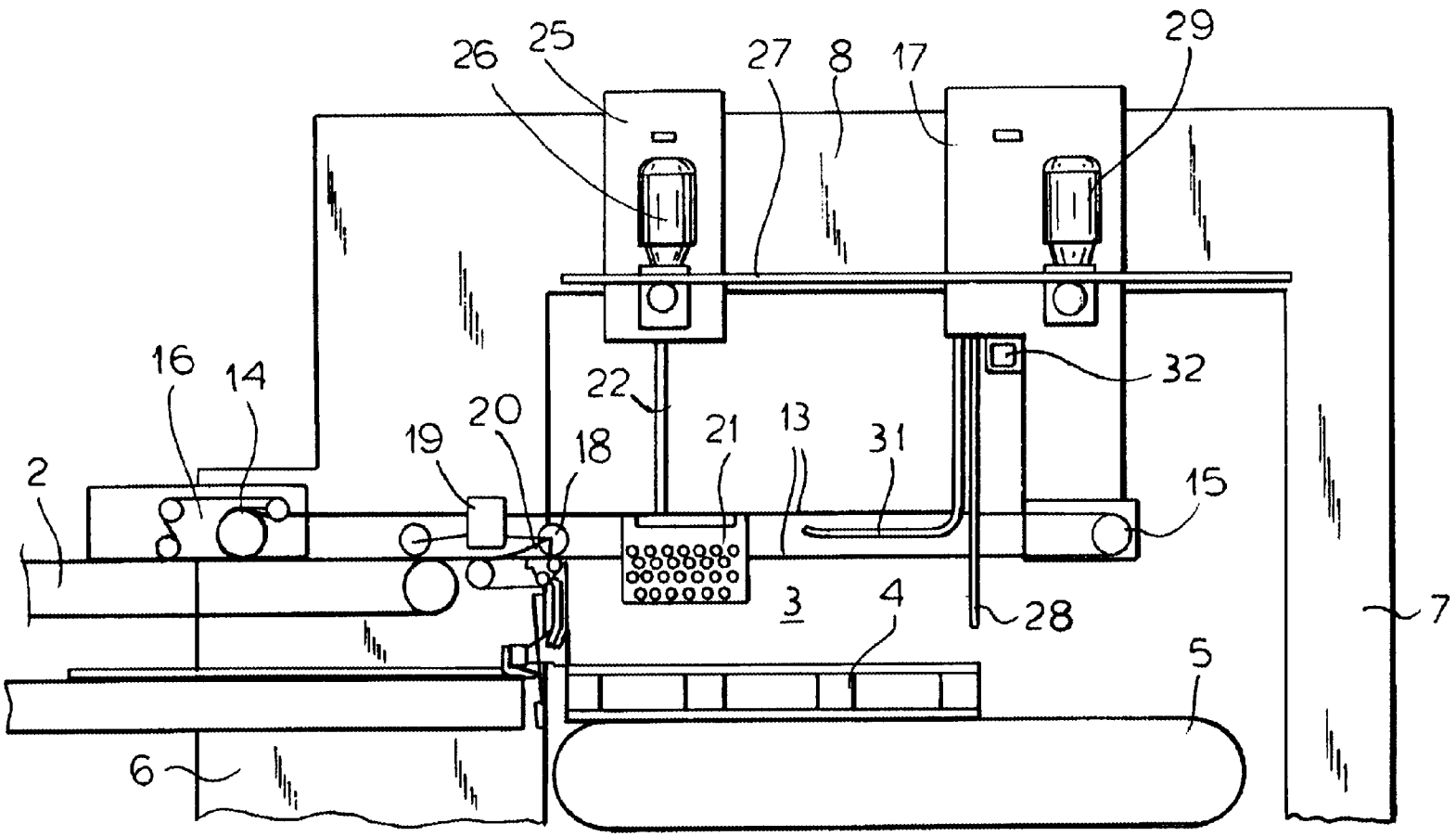
FIG. 2 shows a somewhat enlarged view.

FIG. 2 shows the stack-forming elements and their relative positions. Directly above the feed plane are several upper belts 13 extending at a spacing from one another in the transport direction and extending from the conveyor 2 at least into the stacking station. Preferably the upper belts 13 extend completely across the stacking station or as shown in FIG. 2 are extensible such that with maximum sheet length they extend over the entire stack 3. In this embodiment they have a width of 30–40 mm. The number of upper belts 13 depends on the sheet material and the station width, increasing when working with sensitive paper sheets 1 so that a spacing can be set between two adjacent upper belts 13 of less than 300 mm. All the upper belts 13 are looped at their upstream and downstream ends over rollers 14 and 15 that extend over the entire working width. The common mounting on two rollers 14 and 15 makes it possible to shift each belt 13 transversely into any new desired position. In the illustrated embodiment the upstream rollers 14 and the downstream rollers 15 are mounted on longitudinally shiftable carriages 16 and 17 so that the position of the downstream roller 15 can be set according to sheet length without changing the length of the working reach.

Downstream of the conveyor 2 and immediately upstream of the stacking station is a row of feed rollers 18 that ensure together with the upper belts 13 the sure feeding of the sheets 1 into the stacking station. Directly above the lower reach of each upper belt 13 is a respective one of the feed rollers 18 whose axial length corresponds to the width of the respective belt 13 so as to bear down on an upper face of the upper belt 13. Each feed roller 18 is carried on a holder 19 that is transversely slidable in the frame and that also serves as a transverse guide for the respective upper belt 13. In this manner on resetting of the holder 19 with the feed roller 13 carried on it the upper belt 13 is also moved into a new position. Each holder 19 is transversely displaceable on a guide rail that makes it assume only predetermined transversely spaced positions. In this embodiment the spacing between adjacent possible positions is 100 mm. Since each holder 19 also serves as a guide for the respective upper belt 13, the upper belts 13 can also thus assume the predetermined transverse positions.

The apparatus has separating shoes 20 that are effective as stack-forming elements on the longitudinal edges of a sheet 1 and that have on each longitudinal side a vertical face that serves to bend up the longitudinal edges of two adjacent sheets 1. This bending of a sheet 1 along its longitudinal edges has a stabilizing effect and also effects a sure separation of two adjacent sheets 1. The separating shoes 20 are arranged at the end of the conveyor 2 immediately upstream of the stacking station and level with the conveyor plane. In order that both longitudinal edges can be affected, their number is larger than the maximum number of stacks to be formed. They are steplessly adjustable transverse to the transport direction so that their transverse positions can accommodate any possible longitudinal-edge position. In addition they are mounted such that they can be raised up above the upper belt 13. Raising and lowering is done by piston-cylinder units 37 whose lower ends are fixed to respective separating elements 18.

Further separating plates 21 serving as stack-forming elements effective on the longitudinal sheet edges are mounted in the stacking station level with the conveyor plane between two stacks 3 and along the two outer longitudinal edges of the outer stack 3. Their number and transverse positions correspond to the number of separating shoes 20. The separating plates 21 serve for edge-aligned settling of the sheets 1 in the stacks 3 by guiding the sheets 1 laterally and aligning them. Normally the separating plates 21 are vibrated in order to encourage the alignment of the sheets 1 in the stacks 3. The separating plates 21 are also transversely movable in the frame of the apparatus so that their positions can be set to the desired positions for the longitudinal edges.

The separating plates 21 are fixed releasably at lower ends of the pistons of respective upright piston-cylinder units 22 by means of which they can be raised above the upper belts 13. The cylinder of each piston-cylinder unit 22 is mounted in a holder 23 that is transversely shiftable along a transverse beam 24. The transverse beam 24 is secured at each of its ends on a respective carriage 25 that is longitudinally slidable on the longitudinal beam 8. An electric motor 26 mounted on the carriage 25 serves to longitudinally shift the carriage 25 by means of a drive gear meshing with a rack 27 that extends longitudinally and is fixed to the longitudinal beam 8.

It is significant to the invention that the upper belts 13 are adjustable independently of the stacking elements (here separating shoes 20 and separating plates 21) acting on the longitudinal edges. The independent adjustability makes it possible to automate the transverse adjustment without needing to stock too many stack-forming elements.

The downstream end of the stacking station is provided with a stop plate 28 extending transversely across the full working width. In order to adjust the position of the stop plate 28 in the longitudinal direction for different paper lengths, it is suspended to be longitudinally slidable. Preferably the stop plate 28 is suspended at its sides from the carriages 17 in which the downstream rollers 15 of the upper belts 13 are journaled. An electric motor 29 mounted on the carriage 17 is a longitudinal drive and has a drive gear also meshing with the rack 27. The stop plate 28 has at uniform spacings in all possible transverse positions of the upper belts 13 downwardly open notches through which the upper belts 13 can pass. In this embodiment the spacing between two notches is thus also 100 mm. The widths of the notches are greater than the widths of the upper belts 13 and they extend downward from above to above the region of the upper reaches of the upper belts 13. In addition the stop plate 28 is liftable by a lifter, for example a piston-cylinder unit 30, so that its lower edge is above the upper reach of the upper belts 13. This makes it possible to transversely move the upper belts 13 independently of the longitudinal position of the stop plate 28.

Furthermore immediately upstream of the stop plate 28 and transversely above the full working width there is a row of blow tubes 31 that separate the sheets 1 from the upper belts 13 by means of pressurized-air jets that come from above and also make the sheets 1 settle in a trouble-free manner on a stack 3. Between two adjacent upper belts 13 there is one blow tube 31 whose lower side is provided with nozzles and extends parallel to the top of the stack but against the sheet-travel direction at least over the downstream portion of a stack 3. The blowing tubes 31 have respective upwardly bent feed tubes without nozzles by means of which they are connected to a hollow beam 32 extending transversely across the full working width and serving to feed in pressurized air. The hollow beam 32 is fixed on the carriages 17 so that the blow tubes 31 are moved longitudinally synchronously with the stop plate 28 and the downstream rollers 15 of the upper belts 13. Their feed tubes removably connect the blow nozzles 31 to the hollow beam 32 so that if necessary they can be simply unhooked and removed before transversely positioning the upper belts 13. If necessary they are switched with other blow tubes with a blow part corresponding the new sheet length and/or rehung in new positions. The beam 32 thus has on its upper side a row of closable connection nipples in each of which a blow tube 31 can be hung.

Figure 3:
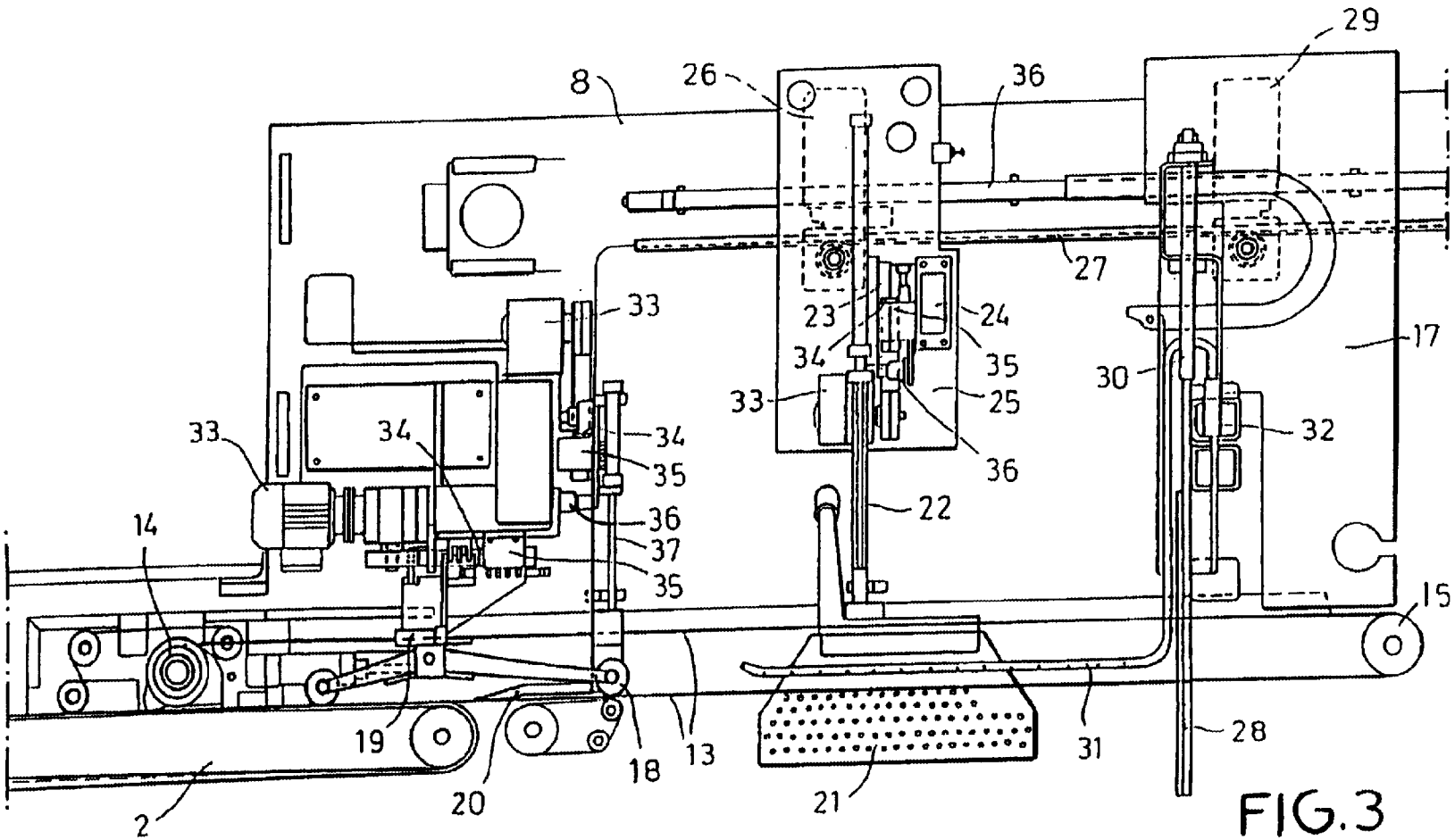
FIG. 3 shows details of the stack-forming elements and their adjustment devices.

FIG. 3 shows in detail the adjustment devices of the individual stack-forming elements. In this embodiment the separating plates 22 and the separating shoes 21 each have their own transverse adjustment devices. Similarly it is possible to transversely position both stack-forming elements with a common adjustment device since they are each positioned according to the position of the longitudinal edges of the sheets 1.

The three transverse-adjusting devices are all built about the same. Identical parts are identified with the same reference numerals for the sake of simplicity. Each has extending transversely across the full working width as adjustment drive a continuous belt 34 driven by a motor 33 and mounted in the frame of the stacking apparatus. The holder 19 of each stack-forming element is a respective piston-cylinder unit 35 that serves to couple the respective element to a reach of the moving belt 34 to make an adjustment movement. The respective stack-forming elements can be coupled together and moved by the respective belts 34 to their new desired positions. There they are again disconnected from the respective belt 34 and clamped by a further piston-cylinder unit onto their respective guide rails in order to fix them in the new desired positions.

To control the positioning movement of each stack-forming element, each adjustment device has a position-detecting system that measures the position of each holder 19 of a stack-forming element on its guide rail. Preferably a position-detecting system that measures absolute position is used, employing magnetic or ultrasound effects to determine distance. Each position-detecting system has a measuring tube 36 extending over the full working width and along which a magnet fixed to the respective holder 19 is slidable with play. In the measuring tube 36 current pulses create magnetic fields that coact with the permanent magnets and make respective ultrasound pulses or magnetostrictions whose parameters are indicative of the actual position.

The same position-measuring system is used to determine the longitudinal positions of the separating plates 21 and the stop plate 28. FIG. 3 shows the measuring tube 36 extending longitudinally over the entire stacking station and secured on the upper longitudinal beam 8.

The sequence of the actual positioning operations is described below with references to FIGS. 4 through 9 during change of sheet format with respect to length and width to a smaller size.

Figure 5:
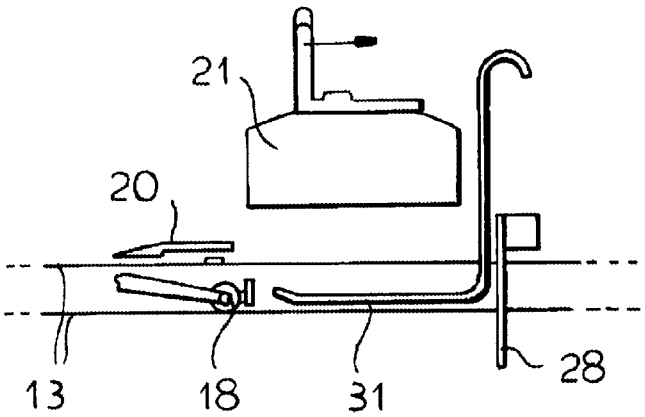
FIGS. 4 through 9 show the positioning of the stack-forming elements for a new sheet size.
Figure 4:
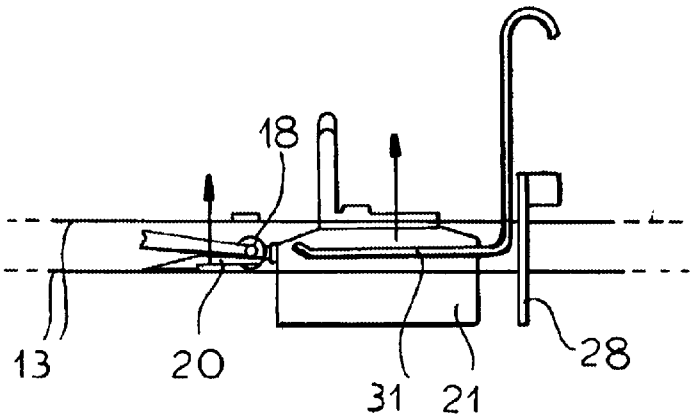
Figure 6:
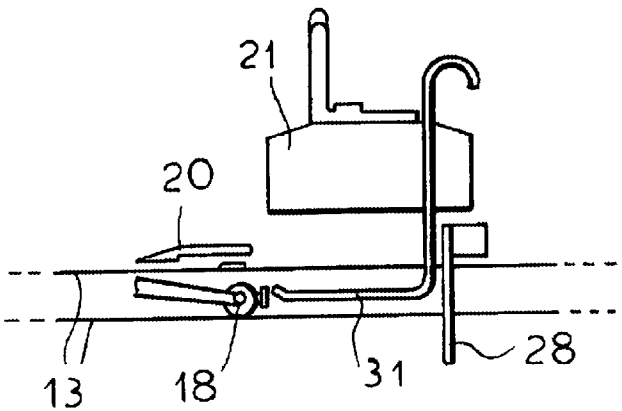
Figure 8:
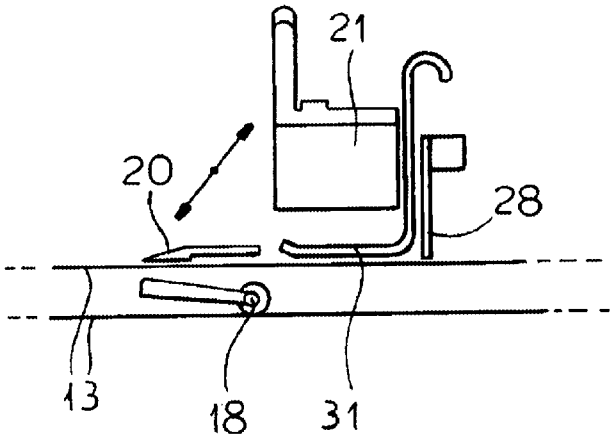
Figure 7:
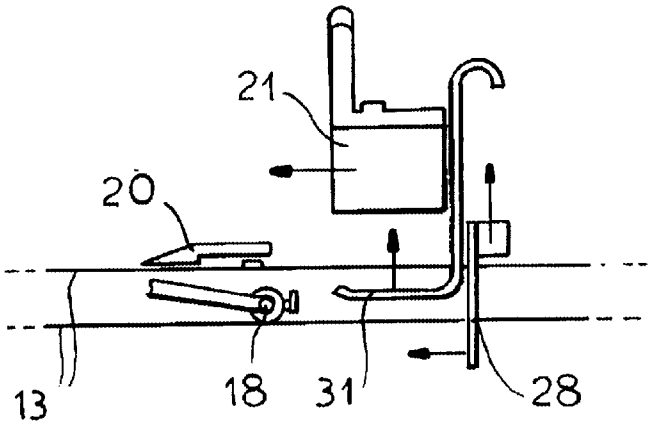
Figure 9:
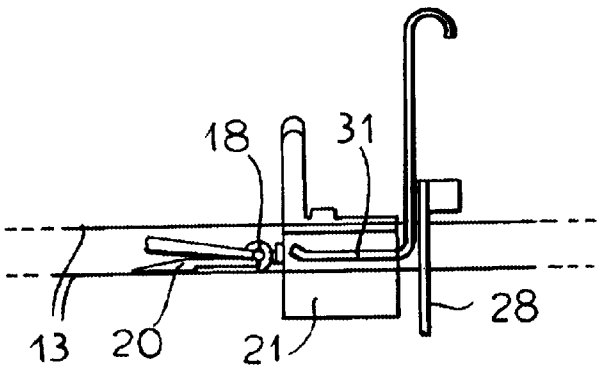

First the separating shoes 20 and the separating plates 21 are raised above the upper belts 13 (FIG. 4). Then the separating plates 21 are shifted along the stop plate 28 to a changeover position (FIG. 5). In the changeover position the separating plates 21 and the blow tubes 31 are replaced with others of shorter length (FIG. 6). After installing the new separating plates 21 and blow tubes 31, the stop plate 28 and the blow tubes 31 are moved into a position above the upper belts 13 and then shifted longitudinally against the sheet-travel direction into their new longitudinal position as shown in FIG. 7. In the raised position of the stop plate 28, the separating shoes 20, the separating plates 21, and the blow tubes 31, all the elements except for the blow tubes 31 and the stop plate 28 extending across the working width are in their new transverse positions. The upper belts 13 are to this end advanced by the holder 19 of the feed rollers 18 since they are guided by the holders 19 of the respective feed rollers 18. During adjustment the upper belts 13 are shifted on the throughgoing rollers 14 and 15. In order that they follow a movement of a holder 19 of a feed roller 18, during transverse adjustment they are set in motion. When the stack-forming elements have reached their transverse positions, the separating shoes 20, the separating plates 21, and the stop plate 28 are dropped back into their working positions (FIG. 9). The stacking device can start to form stacks 3 of sheets 1 of the new format.

What is claimed is:

1. An apparatus for stacking sheets, the apparatus comprising:

conveyor means for delivering a succession of the sheets in a longitudinal transport direction on a conveyor plane to an upstream side of a stacking station with longitudinal edges of the sheets extending parallel to the direction;

a vertically displaceable platform in the station below the plane and adapted to receive the sheets in a stack;

a row of upper feed belts extending in the direction immediately above the conveyor means and the station and having lower reaches engageable down against the sheets on the conveyor at the upstream side of the station;

belt-adjustment means for moving the upper feed belts transversely of the direction and setting the upper feed belts in any of a plurality of different transversely offset positions;

a pair of transversely spaced separating shoes engageable under the longitudinal edges of the sheets at the upstream side of the station; and shoe-adjustment means for moving the shoes transversely of the direction independently of the upper feed belts and setting the shoes in any of a plurality of different transversely offset positions.

2. The sheet-stacking apparatus defined in claim 1 wherein the belt-adjustment means and shoe-adjustment means each comprise an endless driven belt extending transversely over an entire working width of the apparatus and couplable to the respective belts and shoes.

3. The sheet-stacking apparatus defined in claim 1 wherein the shoe- and belt-adjustment means each have an absolute positioning-measuring system extending across a working width of the apparatus for controlling positioning.

4. An apparatus for stacking sheets, the apparatus comprising:

conveyor means for delivering a succession of the sheets in a longitudinal transport direction on a conveyor plane to an upstream side of a stacking station with longitudinal edges of the sheets extending parallel to the direction;

a vertically displaceable platform in the station below the plane and adapted to receive the sheets in a stack;

a row of upper feed belts extending in the direction immediately above the conveyor means and the station and having lower reaches engageable down against the sheets on the conveyor means at the upstream side of the station;

belt-adjustment means for moving the upper feed belts transversely of the direction and setting the upper feed belts in any of a plurality of different transversely offset positions;

a row of feed rollers at a downstream end of the conveyor means; and a common adjustment mechanism linking the row of feed rollers with the upper feed belts for joint transverse movement therewith.

5. The sheet-stacking apparatus defined in claim 4, further comprising respective holders carrying the feed rollers and forming guides for the upper feed belts.

6. An apparatus for stacking sheets, the apparatus comprising:

conveyor means for delivering a succession of the sheets in a longitudinal transport direction on a conveyor plane to an upstream side of a stacking station with longitudinal edges of the sheets extending parallel to the direction;

a vertically displaceable platform in the station below the plane and adapted to receive the sheets in a stack;

a row of upper feed belts extending in the direction immediately above the conveyor means and the station and having lower reaches engageable down against the sheets on the conveyor means at the upstream side of the station;

belt-adjustment means for moving the upper feed belts transversely of the direction and setting the upper feed belts in any of a plurality of different transversely offset positions; and upstream and downstream rollers extending a full working width of the apparatus and over which the upper feed belts are looped.

7. An apparatus for stacking sheets, the apparatus comprising:

conveyor means for delivering a succession of the sheets in a longitudinal transport direction on a conveyor plane to an upstream side of a stacking station with longitudinal edges of the sheets extending parallel to the direction;

a vertically displaceable platform in the station below the plane and adapted to receive the sheets in a stack;

a row of upper feed belts extending in the direction immediately above the conveyor means and the station and having lower reaches engageable down against the sheets on the conveyor means at the upstream side of the station;

belt-adjustment means for moving the upper feed belts transversely of the direction and setting the upper feed belts in any of a plurality of different transversely offset positions; and a respective transversely positionable separating plate in the station at each longitudinal edge of a sheet.

8. The sheet-stacking apparatus defined in claim 7, further comprising a separate adjustment mechanism for transversely positioning the separating plates.

9. The sheet-stacking apparatus defined in claim 7, further comprising:

a pair of transversely spaced separating shoes coupled to the separating plates and engageable under the longitudinal edges of the sheets at the upstream side of the station for stacking the sheets.

10. An apparatus for stacking sheets, the apparatus comprising:

conveyor means for delivering a succession of the sheets in a longitudinal transport direction on a conveyor plane to an upstream side of a stacking station with longitudinal edges of the sheets extending parallel to the direction;

a vertically displaceable platform in the station below the plane and adapted to receive the sheets in a stack;

a row of upper feed belts extending in the direction immediately above the conveyor means and the station and having lower reaches engageable down against the sheets on the conveyor means at the upstream side of the station, the upper feed belts being extensible over all of the station and capable of assuming only predetermined transversely offset positions;

belt-adjustment means for moving the upper feed belts transversely of the direction and setting the upper feed belts in any of the transversely offset positions; and a stop plate extending over an entire working width of the apparatus, longitudinally adjustable, and having cutouts in which fit the upper feed belts in all their transverse positions.

11. The sheet-stacking apparatus defined in claim 10 wherein the stop plate has downwardly open notches and is raisable to above the upper feed belts.

* * * * *